US007750219B2

(12) United States Patent
Simons et al.

(10) Patent No.: US 7,750,219 B2
(45) Date of Patent: Jul. 6, 2010

(54) FOLDING BAR CHIMES

(75) Inventors: Richard Simons, Garfield, NJ (US); Raymond Enhoffer, Clifton, NJ (US); Andrze J. Krol, Wayne, NJ (US)

(73) Assignee: Kaman Music Corporation, Bloomfield, CT (US)

( * ) Notice: Subject to any disclaimer, the term of this patent is extended or adjusted under 35 U.S.C. 154(b) by 190 days.

(21) Appl. No.: 12/013,661

(22) Filed: Jan. 14, 2008

(65) Prior Publication Data

US 2009/0178536 A1 Jul. 16, 2009

(51) Int. Cl.
*G10D 13/08* (2006.01)

(52) U.S. Cl. ..... 84/402

(58) Field of Classification Search ..... 84/402–410
See application file for complete search history.

(56) References Cited

U.S. PATENT DOCUMENTS 5,208,578 A * 5/1993 Tury et al. ..... 340/392.2
6,525,248 B2 * 2/2003 Chatkeonopadol ..... 84/402

* cited by examiner

*Primary Examiner*—Kimberly R Lockett
(74) *Attorney, Agent, or Firm*—Ohlandt, Greeley, Ruggiero & Perle, L.L.P.

(57) ABSTRACT

A bar chime apparatus has a mantle with one or more pivot mechanisms that connect two or more bar segments. The one or more pivot mechanisms have two or more slots. The two or more bar segments can be folded and secured in the two or more slots. Two or more bar chimes are suspended from the mantle.

19 Claims, 8 Drawing Sheets

FOLDING BAR CHIMES

BACKGROUND OF THE INVENTION

1. Field of the Invention

The present disclosure relates to a folding bar chime apparatus having a mantle with a plurality of bar segments that are connected by one or more pivot mechanisms.

2. Description of Related Art

Traditional bar chimes are constructed with a horizontal mantle having a bar segment manufactured from a single piece. These bar chimes have limited pitch and tonal capabilities because there are only a few number of positions in which the bar chimes can be arranged. The traditional bar chimes are also cumbersome and difficult to transport.

Accordingly, there is a need for folding bar chimes that have a plurality of bar segments that are connected by one or more pivot mechanisms to provide a compact and portable musical apparatus. The folding bar chimes allow a user to vary the sequencing of the bar chimes to enhance the versatility of the pitch and tone that is produced by the apparatus.

SUMMARY OF THE INVENTION

The present disclosure provides a bar chime apparatus having a virtually horizontally positionable mantle with a plurality of bar chimes suspended therefrom. The mantle has a plurality of bar segments that are connected by one or more pivot mechanisms.

The present disclosure also provides a bar chime apparatus in which the plurality of bar segments can be folded using the one or more pivot mechanisms so that the bar segments have an angle therebetween. In another embodiment, the bar segments can be folded so that they are adjacent to or flush with one another.

The present disclosure further provides a bar chime apparatus having a gripping hole that allows a user to securely hold or position the apparatus. The bar chime apparatus also has an anti-twist mounting bracket that is connected to the mantle via a knurled head thumb screw and a flat washer.

The present disclosure still further provides a pivot mechanism having a male locking plate and a female locking plate that pivot on a pivoting axis. The pivoting axis has a pin, a spring and a lock nut therein.

The present disclosure yet further provides a pivot mechanism having a plurality of slots so that the mantle can be folded to a plurality of different angles.

These and other advantages and benefits of the present disclosure are provided by a bar chime apparatus having a virtually horizontally positionable mantle with one or more pivot mechanisms that connect a plurality of bar segments. A plurality of bar chimes are suspended from the mantle. The one or more pivot mechanisms have a plurality of slots therein. The plurality of bar segments can be folded and secured in the plurality of slots.

The above-described and other features and advantages of the present disclosure will be appreciated and understood by those skilled in the art from the following detailed description, drawings, and appended claims.

DETAILED DESCRIPTION OF THE INVENTION

Figure 1:
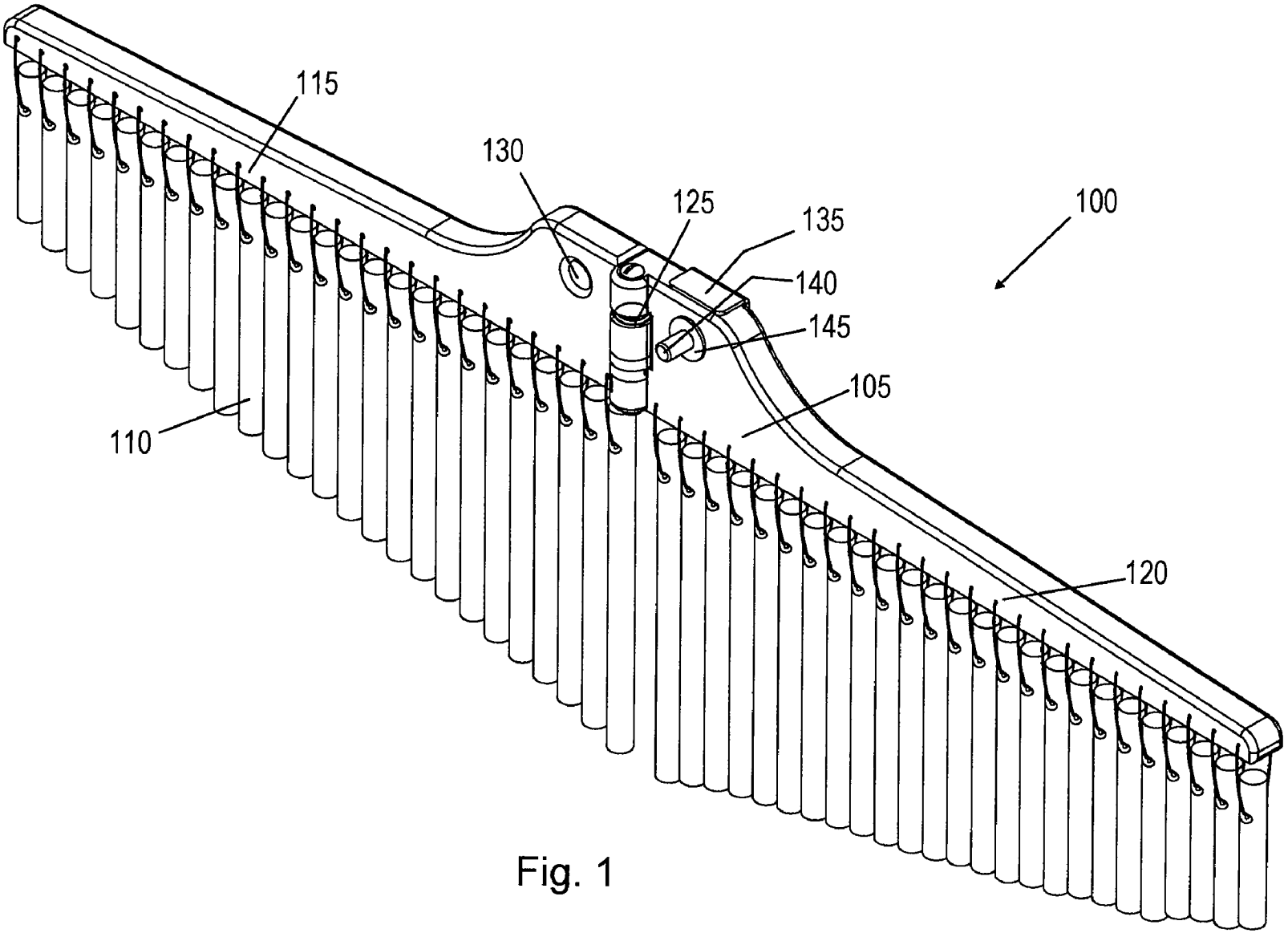
FIG. 1 is a three-dimensional view of an exemplary embodiment of the bar chime apparatus of the present disclosure that has two bar segments.

Referring to the drawings and, in particular, FIG. 1, a bar chime apparatus generally referred to by reference number 100 is shown. In an exemplary embodiment, bar chime apparatus 100 has a virtually horizontally positionable mantle 105 with a plurality of bar chimes 110 suspended therefrom. Virtually horizontal means that adjacent bar chimes 110 do not contact each other when in their resting position prior to being struck. Mantle 105 has a first bar segment 115 and a second bar segment 120. First and second bar segments 115, 120 are connected via a pivot mechanism 125. In an exemplary embodiment, first and second bar segments 115, 120 have lengths measured from pivot mechanism 125 to each respective distal end, that are equal in length. Each bar segment 115, 120 has at least one bar chime 110 and, preferably, a plurality of bar chimes 110.

Bar chimes 110 have varying lengths that range from 3 inches to 8 inches. In an exemplary embodiment, the longest bar chimes 110 are suspended from a center of mantle 105 and the length of bar chimes 110 get gradually smaller in length as they move away from the center of mantle 105. The aforementioned arrangement of bar chimes 110 is advantageous because it is lightweight, portable, and it provides a sleeker and more aesthetically pleasing appearance. In another exemplary embodiment, the shortest bar chimes 110 are suspended from the center of mantle 105 and the length of bar chimes 110 get gradually longer in length as they move away from the center of mantle 105. Bar chimes 110 have a diameter that ranges from ¼ inches to ½ inches. The preferred diameter of bar chimes 110 is ⅜ inches.

Figure 2:
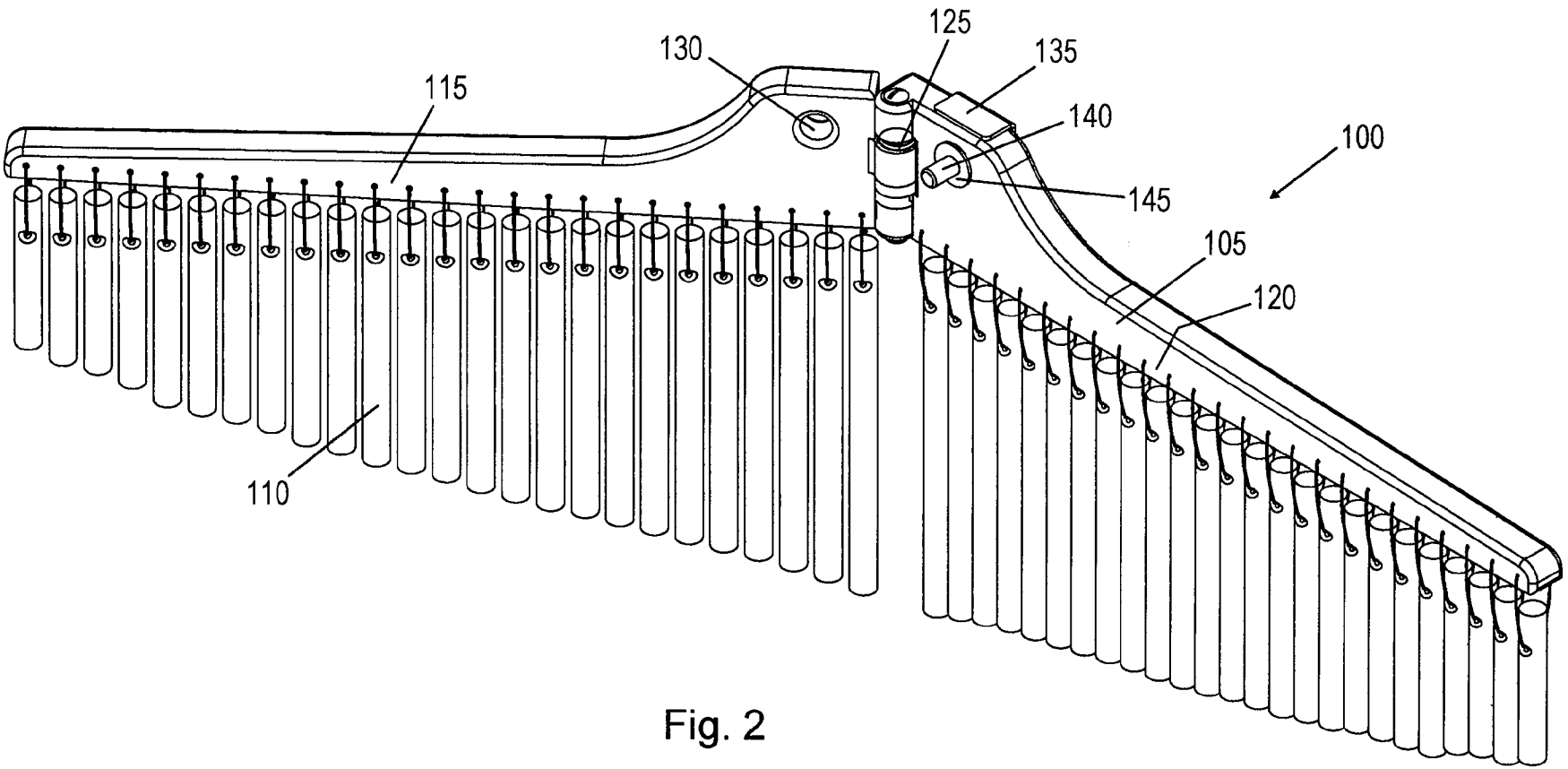
FIG. 2 is a three-dimensional view of the bar chime apparatus of FIG. 1, in which the two bar segments are folded to provide a one hundred thirty-five degree angle between the two segments.

In an exemplary embodiment, first and second bar segments 115, 120 can be folded using pivot mechanism 125 so that the bar segments have a one hundred thirty-five degree angle therebetween, as shown clearly in FIG. 2. This arrangement unexpectedly enhances the versatility of the pitch and tone of bar chime apparatus 100 by allowing larger chimes in a smaller space.

Figure 3:
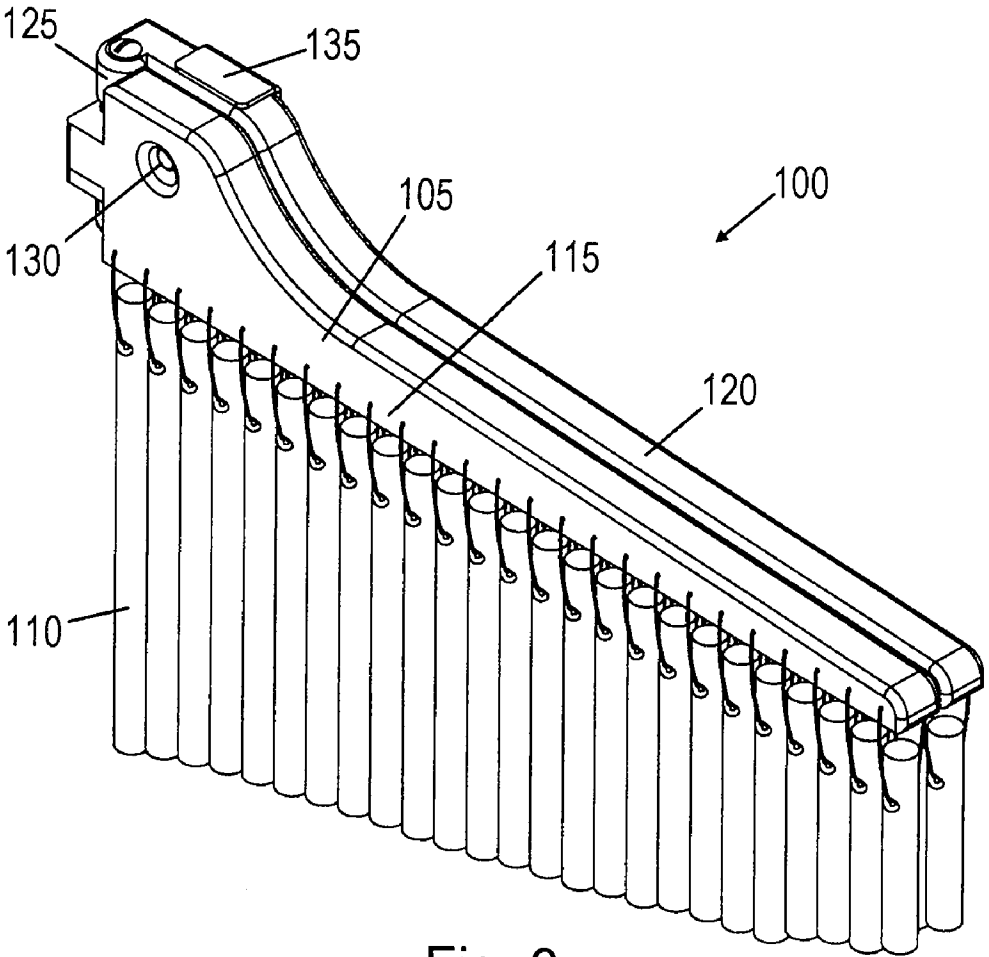
FIG. 3 is a three-dimensional view of the bar chime apparatus of FIG. 1, in which the two bar segments are folded so that the two segments are adjacent to one another.

In another exemplary embodiment, first and second bar segments 115, 120 can be folded using pivot mechanism 125 so that the bar segments are adjacent to one another, as shown clearly in FIG. 3. When first and second bar segments 115, 120 are adjacent to one another, the length of adjacent bar chimes 110 mirror each other and first and second bar segments 115, 120 are flush with one another. This arrangement unexpectedly enhances the versatility of the pitch and tone of bar chime apparatus 100. First and second bar segments 115, 120 can be arranged so that the length of bar chimes 110 can be down up (as shown in FIG. 1) or up down and, again, can be such that adjacent bar chimes 110 from first and second bar segments 115, 120 mirror each other. The tuning of bar chimes 110, determined by the bar lengths can be arranged in various intervals including full steps, half steps, major scales, minor scales and modal scales of unlimited varieties.

Bar chimes 110 are manufactured from a material that can be hollow brass, solid aluminum, glass, titanium alloy or any other material that is dense enough to produce sound waves when struck. In an exemplary embodiment, bar chimes 110 on first bar segment 115 and bar chimes 110 on second bar segment 120 are manufactured from different materials so that when first and second bar segments 115, 120 are folded to the point that they are adjacent to one another, adjacent bar chimes 110 are manufactured from different materials. Different combinations of materials for bar chimes 110, especially adjacent bar chimes, allows for new sounds. For example, folding a set of brass bar chimes 110 from second bar segment 120 over aluminum bar chimes 110 of first bar segment 115 adds complexity to the sound produced by bar chime apparatus 100. Similarly, folding a set of glass bar chimes 110 of second bar segment 120 over aluminum bar chimes 110 of first bar segment 115 also adds complexity to the sound that bar chime apparatus 100 produces.

Bar chime apparatus 100 can also produce new sounds by bar tuning. Bar chimes 110 can be arranged so that they produce a particular harmonic effect when bar chime apparatus 100 is in the open position and a different harmonic effect when bar chime apparatus 100 is in the closed position. The harmonic effects vary according to the nature of the bar tuning. For example, bar chimes 110 can be tuned in thirds, fifths, octaves or to atonal sound effects when chime apparatus 100 is in the closed position.

In virtually all embodiments, bar chime apparatus 100 has a gripping hole 130 that allows a user to securely hold or position the apparatus. In virtually all embodiments, bar chime apparatus 100 also has an anti-twist mounting bracket 135 that is connected to mantle 105 via a knurled head thumb screw 140 and a flat washer 145.

Figure 4:
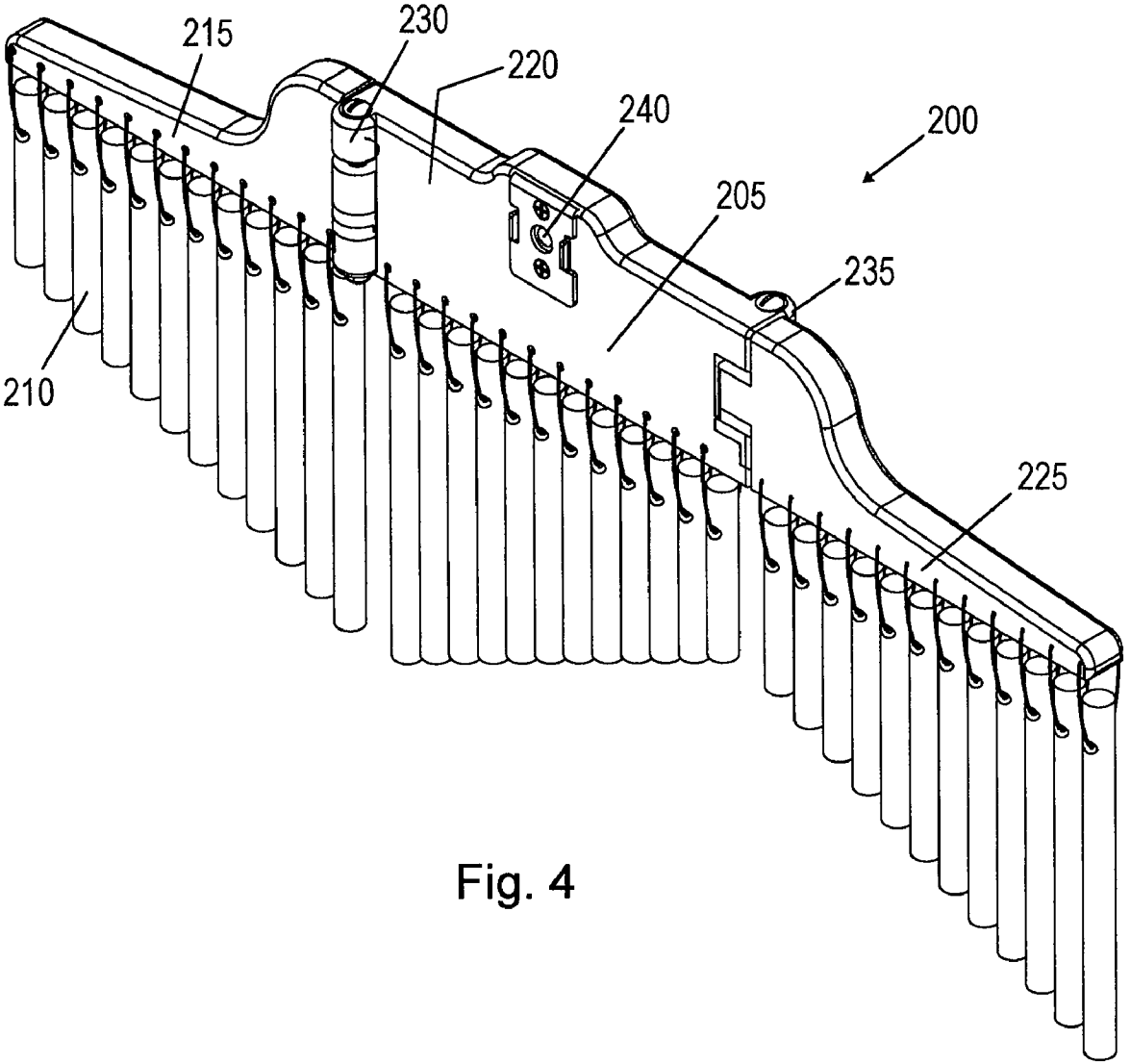
FIG. 4 is three-dimensional view of a second exemplary embodiment of the bar chime apparatus of the present disclosure that has three bar segments.

In another exemplary embodiment illustrated in FIG. 4, a bar chime apparatus generally referred to by reference number 200 is shown. Bar chime apparatus 200 has a virtually horizontally positionable mantle 205 with a plurality of bar chimes 210 suspended therefrom. Mantle 205 has a first bar segment 215, a second bar segment 220, and a third bar segment 225. As in FIG. 1, each bar segment 215, 220, 225 has at least one bar chime 210 and, preferably, a plurality of bar chimes 210. In an exemplary embodiment, first bar segment 215, second bar segment 220, and third bar segment 225 have equal lengths. First bar segment 215 and second bar segment 220 are connected by a first pivot mechanism 230. Second bar segment 220 and third bar segment 225 are connected via a second pivot mechanism 235.

Figure 5:
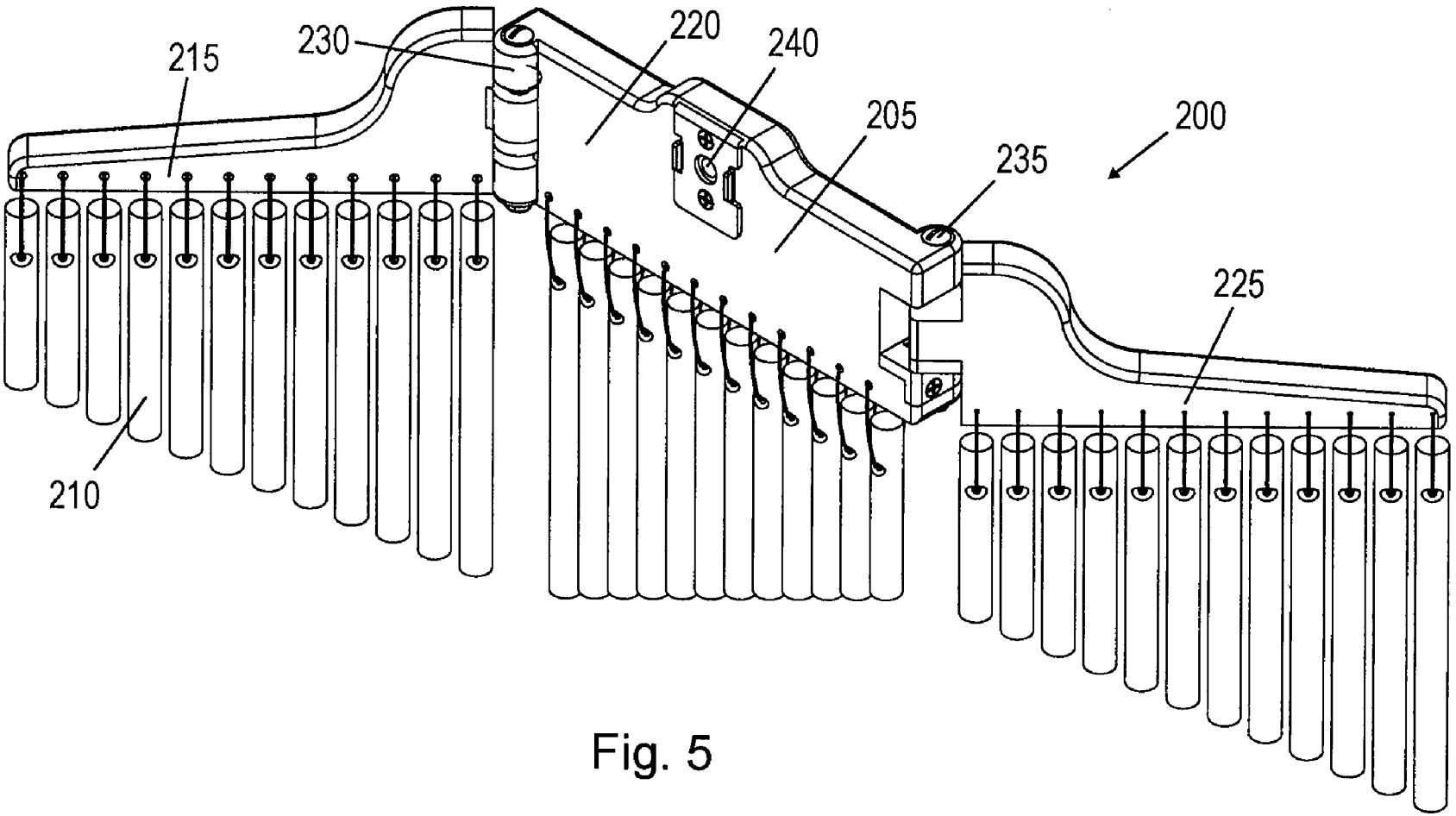
FIG. 5 is a three-dimensional view of the bar chime apparatus of FIG. 4, in which the three bar segments are folded to provide a one hundred thirty-five degree angle between each adjacent pair of the three segments.

In an exemplary embodiment, first bar segment 215 and third bar segment 225 can be folded using first pivot mechanism 230 and second pivot mechanism 235, respectively, so that each bar segment has a one hundred thirty-five degree angle between it and second bar segment 220, as shown clearly in FIG. 5. This arrangement unexpectedly enhances the versatility of the pitch and tone of bar chime apparatus 200 by allowing larger chimes in a smaller space.

Figure 6:
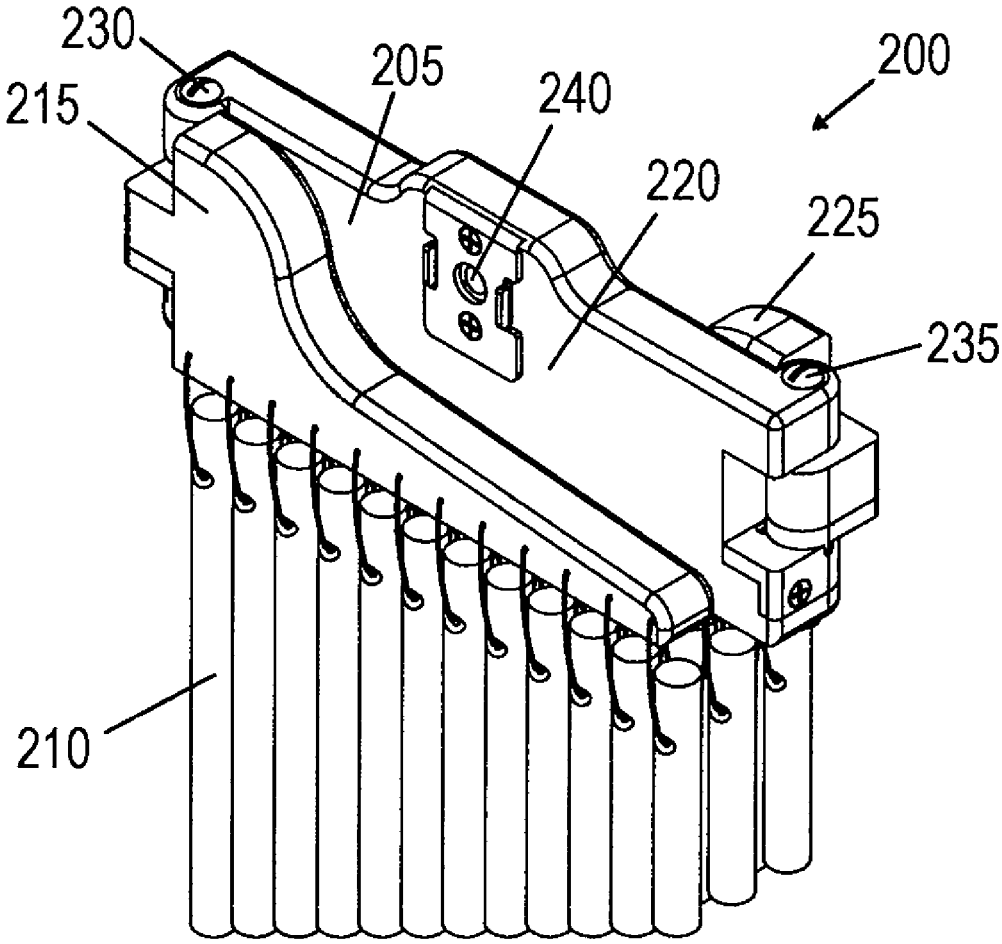
FIG. 6 is a three-dimensional view of the bar chime apparatus of FIG. 4, in which the three bar segments are folded so that the three segments are adjacent to one another.

In another exemplary embodiment, first bar segment 215 and third bar segment 225 can be folded using first pivot mechanism 230 and second pivot mechanism 235, respectively, so that first bar segment 215, second bar segment 220, and third bar segment 225 are adjacent to one another with second bar segment 220 positioned between first and third bar segments 215, 225, as shown clearly in FIG. 6. When the bar segments are adjacent to one another, the length of adjacent bar chimes 210 mirror each other and the bar segments are flush with one another. First bar segment 215, second bar segment 220, and third bar segment 225 can be arranged so that the length of bar chimes 210 can be down up (as shown in FIG. 6) or up down and, again, can be such that adjacent bar chimes 210 from first, second and third bar segments 215, 220 and 225, mirror each other. This arrangement unexpectedly enhances the versatility of the pitch and tone of bar chime apparatus 200. In an exemplary embodiment, triads, or three-note chords, can be created by having a single note on each bar segment so that bar chime apparatus 200 would only sound a chord when all bar segments are folded together. Bar tuning can further produce triads that are tuned so as to be major, minor, diminished, augmented, as well as other harmonic tunings or pitch arrangements that produce various tonal and atonal effects.

In virtually all embodiments, bar chime apparatus 200 has a gripping hole 240 that allows a user to securely hold or position the apparatus. In virtually all embodiments, bar chime apparatus 200 also has an anti-twist mounting bracket (not shown) that is connected to mantle 205 via a knurled head thumb screw (not shown) and a flat washer (not shown).

Figure 7:
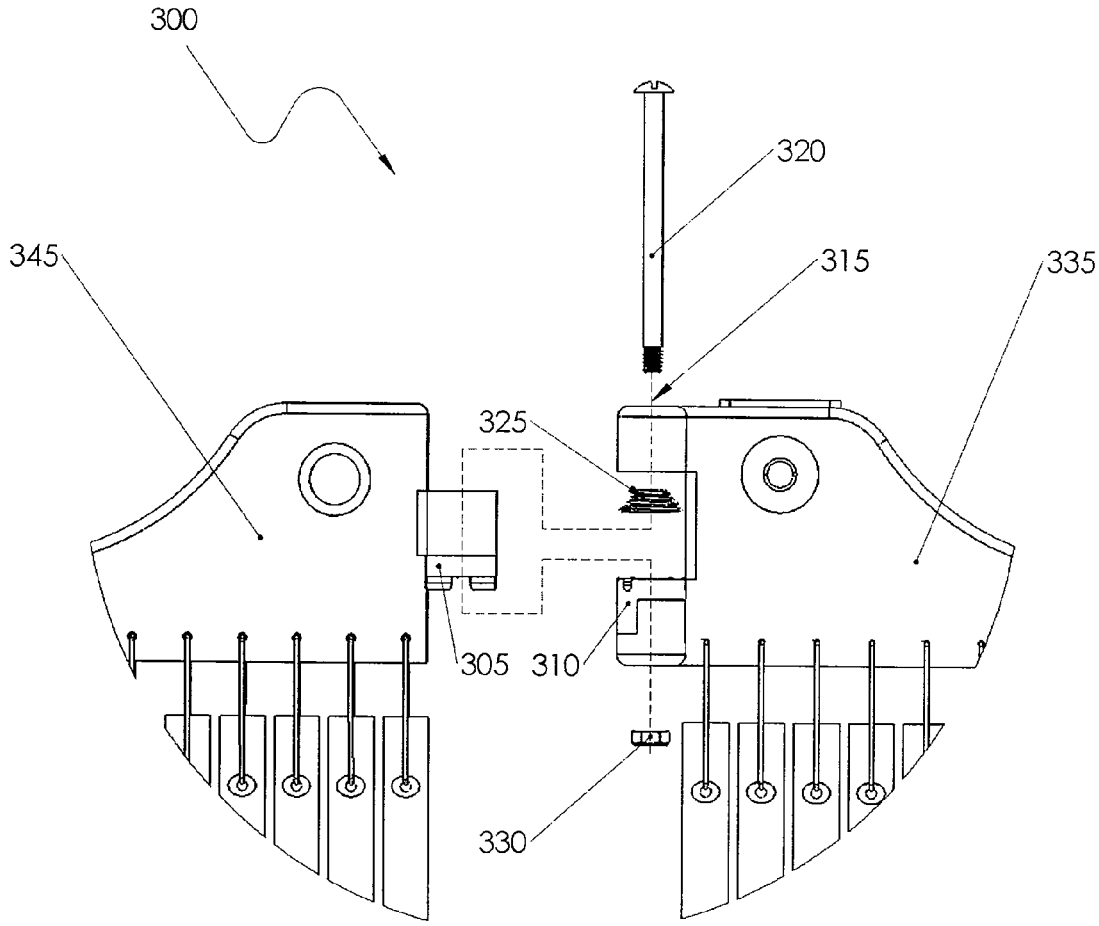
FIG. 7 is a first exploded view of an exemplary embodiment of the pivot mechanism of the present disclosure.
Figure 8:
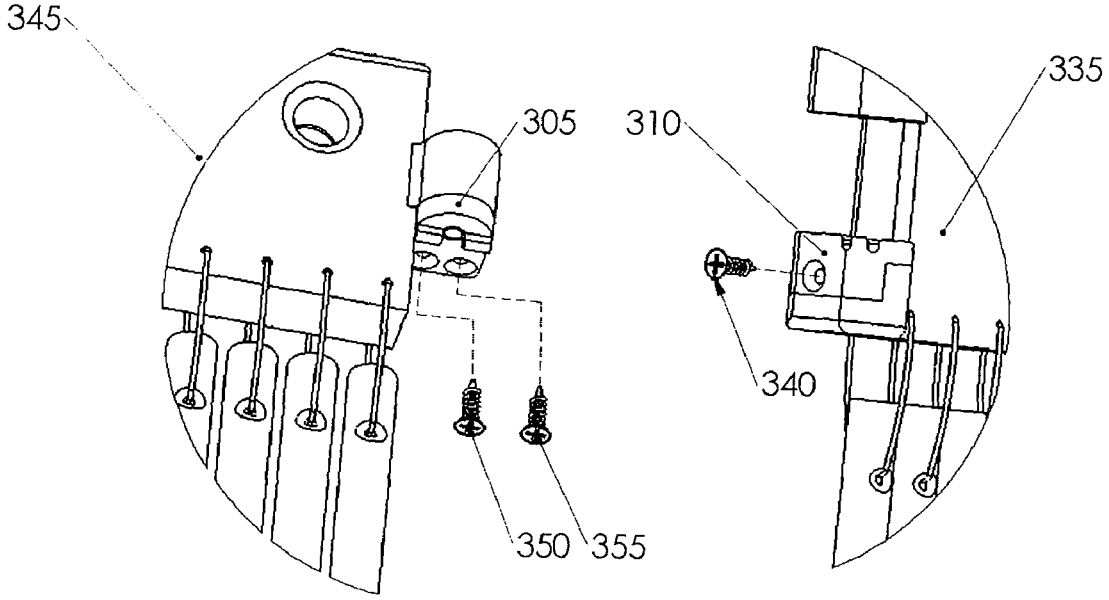
FIG. 8 is a second exploded view of an exemplary embodiment of the pivot mechanism of the present disclosure.

Referring to the drawings and, in particular, FIG. 7 and FIG. 8, a pivot mechanism generally referred to by reference number 300 is shown. Pivot mechanism has a male locking plate 305 and a female locking plate 310 that pivot on a pivoting axis 315. Pivoting axis 315 has a pin 320, a spring 325 and a lock nut 330 therein. As shown in FIG. 8, female locking plate 310 is secured to a first bar segment 335 via a first wood screw 340 disposed horizontally. Male locking plate 305 is secured to a second bar segment 345 via a second wood screw 350 and a third wood screw 355 disposed vertically. In an exemplary embodiment, spring 325 is a conical spring. Pivoting mechanism 300 has a plurality of slots so that first bar segment 335 and second bar segment 345 can be folded to a plurality of different angles.

The bar chime apparatus 100, 200, 300 of the present disclosure can be folded to simply allow a large number of bar chimes to be easily transported or stored in a small, compact space. Moreover, the present bar chime apparatus 100, 200, 300 can have as many segments and pivot mechanisms that are practical to achieve a range of tonal, chordal and atonal effects or sounds. In an exemplary embodiment, tonal reinforcement can be achieved by the bar chime apparatus of the present disclosure by folding over specific segments that duplicate either tonal or chordal sounds. This can give non-tonal chimes a pitch center. For example, a user can fold an A minor chord bar over a non-pitched bar chime and the non-pitched bars can now have a pitch.

In another exemplary embodiment, overlaying bars of different character can change tonal quality. For example, a user can fold a series of bar pitches that are in between the "Lu" scale and the original oriental feel will disappear. The "Lu" scale is based on a Chinese tonal pattern. In yet another exemplary embodiment, tonal quality can be changed from non-tonal chimes by folding over bars that are fixed intervals above the original bars. This changes the sound dramatically. In a further exemplary embodiment, drones, or reoccurring bars, can be added to anchor a single pitch or to add a tonal center in an otherwise atonal sound. Chords can also be created by having a single note on each arm that would only sound a chord when all arms are folded together.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiments disclosed as the best mode contemplated, but that the disclosure will include all embodiments falling within the scope of the appended claims.

What is claimed is:

1. A bar chime apparatus comprising:

a mantle having two or more pivot mechanisms that pivotally connect a plurality of bar segments, wherein said two or more pivot mechanisms have a plurality of slots, wherein said plurality of bar segments can be folded and secured in position in said plurality of slots; and a plurality of bar chimes suspended from said mantle, wherein said two or more pivot mechanisms are a first pivot mechanism and a second pivot mechanism.

2. The bar chime apparatus of claim 1, wherein said first pivot mechanism connects a first one of said plurality of bar segments and a second one of said plurality of bar segments, and wherein said second pivot mechanism connects said second one and a third one of said plurality of bar segments.

3. The bar chime apparatus of claim 1, wherein said plurality of bar segments are positioned adjacent to one another when said two or more pivot mechanisms are in a closed or folded position.

4. The bar chime apparatus of claim 3, wherein said plurality of bar segments are flush with one another.

5. The bar chime apparatus of claim 1, wherein said plurality of bar chimes each has a length that ranges from 3 inches to 8 inches.

6. The bar chime apparatus of claim 1, wherein said plurality of bar chimes each has a diameter that ranges from ¼ inches to ½ inches.

7. The bar chime apparatus of claim 1, wherein said plurality of bar chimes each has a diameter of ⅜ inches.

8. The bar chime apparatus of claim 1, wherein said plurality of bar chimes are manufactured from a material selected from the group consisting of hollow brass, solid aluminum, glass, and titanium alloy.

9. The bar chime apparatus of claim 1, further comprising a gripping hole that allows a user to securely hold or position the bar chime apparatus.

10. A bar chime apparatus comprising:

a mantle having one or more pivot mechanisms that pivotally connect a plurality of bar segments, wherein said one or more pivot mechanisms have a plurality of slots, wherein said plurality of bar segments can be folded and secured in position in said plurality of slots;

a plurality of bar chimes suspended from said mantle; and further comprising an anti-twist mounting bracket that is connected to said mantle via a knurled head thumb screw and a flat washer.

11. A bar chime apparatus comprising:

a mantle having one or more pivot mechanisms that pivotally connect a plurality of bar segments, wherein said one or more pivot mechanisms have a plurality of slots, wherein said plurality of bar segments can be folded and secured in position in said plurality of slots; and a plurality of bar chimes suspended from said mantle, wherein said one or more pivot mechanisms have a male locking plate and a female locking plate that pivot on a pivot axis mechanism, and wherein said pivot axis mechanism has a pin, a spring and a locknut therein.

12. The bar chime apparatus of claim 10, wherein said plurality of bar segments are two bar segments.

13. The bar chime apparatus of claim 12, where each of said two bar segments has a different one of said plurality of bar chimes.

14. The bar chime apparatus of claim 12, wherein each of said two bar segments has the same number of said plurality of bar chimes.

15. The bar chime apparatus of claim 10, wherein said one or more pivot mechanisms is one pivot mechanism.

16. The bar chime apparatus of claim 11, wherein said plurality of bar segments are two bar segments.

17. The bar chime apparatus of claim 16, where each of said two bar segments has a different one of said plurality of bar chimes.

18. The bar chime apparatus of claim 16, wherein each of said two bar segments has the same number of said plurality of bar chimes.

19. The bar chime apparatus of claim 11, wherein said one or more pivot mechanisms is one pivot mechanism.

* * * * *